United States Patent [19]

Nakamura et al.

[11] 4,136,139

[45] Jan. 23, 1979

[54] VARIABLE VENTURI TYPE CARBURETOR

[75] Inventors: Norihiko Nakamura, Mishima; Takaaki Itou; Kazuo Kikuchi, both of Susono, all of Japan

[73] Assignees: Toyota Jidosha Kogyo Kabushiki Kaisha, Toyota; Aisan Industry Col., Ltd., Obu, both of Japan

[21] Appl. No.: 773,935

[22] Filed: Mar. 3, 1977

[30] Foreign Application Priority Data

Dec. 16, 1976 [JP] Japan ..... 51-150281

[51] Int. Cl.[2] ..... F02M 7/24

[52] U.S. Cl. ..... 261/44 C; 261/121 B; 261/67; 261/DIG. 75

[58] Field of Search ..... 261/44 R, 121 A, 67, 261/121 B, DIG. 75, 44 C

[56] References Cited

U.S. PATENT DOCUMENTS

| | | | |
|---|---|---|---|
| 1,935,260 | 11/1933 | Broge | 261/44 R |
| 2,084,489 | 6/1937 | Hess | 261/121 A |
| 3,342,463 | 9/1967 | Date et al. | 261/44 R |
| 3,397,871 | 8/1968 | Hasselberg | 261/DIG. 75 |
| 3,425,672 | 2/1969 | Seigel et al. | 261/121 B |
| 3,684,257 | 8/1972 | Lawrence | 261/121 A |
| 3,764,120 | 10/1973 | Imai | 261/44 R |
| 3,779,530 | 12/1973 | Lawrence | 261/44 R |
| 3,963,009 | 6/1976 | Mennesson | 261/44 R |

FOREIGN PATENT DOCUMENTS

| | | | |
|---|---|---|---|
| 694918 | 7/1953 | United Kingdom | 261/DIG. 75 |

*Primary Examiner*—Tim R. Miles

*Attorney, Agent, or Firm*—Stevens, Davis, Miller & Mosher

[57] ABSTRACT

Disclosed is a variable venturi type carburetor comprising a movable suction piston. The suction piston has a needle entering into a stationary jet. The needle and the jet defines an annular opening through which the fuel is injected into the intake passage formed in the carburetor. The jet is connected to a fuel reservoir via a fuel supply passage. The fuel supply passage is connected to the atmosphere via an air bleed passage. A bubble generating pipe made of sintered metal is disposed in the fuel supply passage at a position in which the air bleed passage opens to the fuel supply passage for creating fine bubbles of air in the fuel.

1 Claim, 2 Drawing Figures

VARIABLE VENTURI TYPE CARBURETOR

DESCRIPTION OF THE INVENTION

The present invention relates to a carburetor, and particularly relates to a variable venturi type carburetor which has a needle fixed to a movable piston, and a fuel injecting jet in an intake passage formed in the carburetor, said needle entering into the fuel injected jet which is arranged so as to face opposite the needle.

In a variable venturi type carburetor, the cross-sectional area of the venturi is varied in accordance with the change in an amount of air fed into the cylinder of the engine, and is controlled so that the velocity of air flowing in the venturi is always maintained at a constant value. In a carburetor of this type, in order to inject into the venturi an amount of fuel proportional to the amount of air flowing in the venturi, a movable needle and a stationary fuel injecting jet are used. The metering operation of the fuel injected from the jet into the air flowing in the venturi is effected in such a way that the annular opening area formed between the outer wall of the needle and the inner wall of the jet is varied. As mentioned above, in a conventional variable venturi type carburetor, only an amount of fuel injected from the jet is controlled due to the movable needle. Consequently, in a conventional carburetor, since it is necessary to select the sizes of the needle and the jet so that the annular opening formed between the outer wall of the needle and the inner wall of the jet has an extremely small area, the irregularity in the accuracy of the size of the manufactured needle and jet, the wear of the needle and the jet, and the change in temperature of the fuel have a great influence on the amount of fuel injected from the jet. Consequently, in a conventional variable venturi type carburetor in which the metering operation of the fuel containing no bubbles of air therein is effected, it is very difficult to accurately meter a fuel injected from the jet. In addition, in a conventional carburetor, a satisfactory pulverizing operation of the fuel cannot be carried out, and a conventional carburetor is required for providing a slow fuel supply system from which the fuel is injected into the air flowing in the carburetor when the amount of air introduced into the cylinder of the engine is relatively small.

In the present invention, by the provision of a bubble generating pipe made of sintered metal, the bubbles having a uniform size are fed into the fuel and are uniformly mixed with the fuel, and the metaling operation of the fuel containing the bubbles therein is effected. Consequently, it is possible to increase the annular opening area formed between the needle and the jet.

An object of the present invention is to provide a variable venturi type carburetor capable of accurately metering the fuel and improving a pulverization of the fuel by increasing the annular opening area formed between the needle and the jet.

Another object of the present invention is to provide a variable venturi type carburetor capable of further accurately metering the fuel in such a manner that, by providing a pressure reducing device in the fuel passage between the bubble generating pipe and the fuel reservoir the bubbles are easily generated from the bubble generating pipe and, at the same time, the annular opening area formed between the needle and the jet is further increased.

According to the present invention, there is provided a variable venturi type carburetor, comprising a housing, a bore extending through said housing and having an inner wall defining an intake passage, a suction piston movably mounted in said housing and having a bottom end face projecting into said intake passage, said bottom end face of the suction piston and said inner wall of the intake passage defining a venturi, said suction piston moving up and down in response to a change in the vacuum produced in said intake passage located downstream of said venturi for maintaining the velocity of air flowing in said venturi at a constant value, a jet disposed on the inner wall of said intake passage at a position facing against the bottom end face of said suction piston, a needle fixed onto the bottom end face of said suction piston and entering into said jet, said jet and said needle defining an annular opening through which fuel is injected into said intake passage, a fuel reservoir in said housing, a fuel supply passage disposed in said housing and communicating said fuel reservoir with said jet, an air bleed passage communicating said fuel supply passage with the atmosphere, and a bubble generating pipe made of sintered metal and disposed in said fuel supply passage at a position in which said air bleed passage opens into said fuel supply passage for creating fine bubbles of air in the fuel contained in said fuel supply passage.

The present invention may be more fully understood from the following description of preferred embodiments of the invention, together with the accompanying drawings.

DESCRIPTION OF PREFERRED EMBODIMENTS

Figure 1:
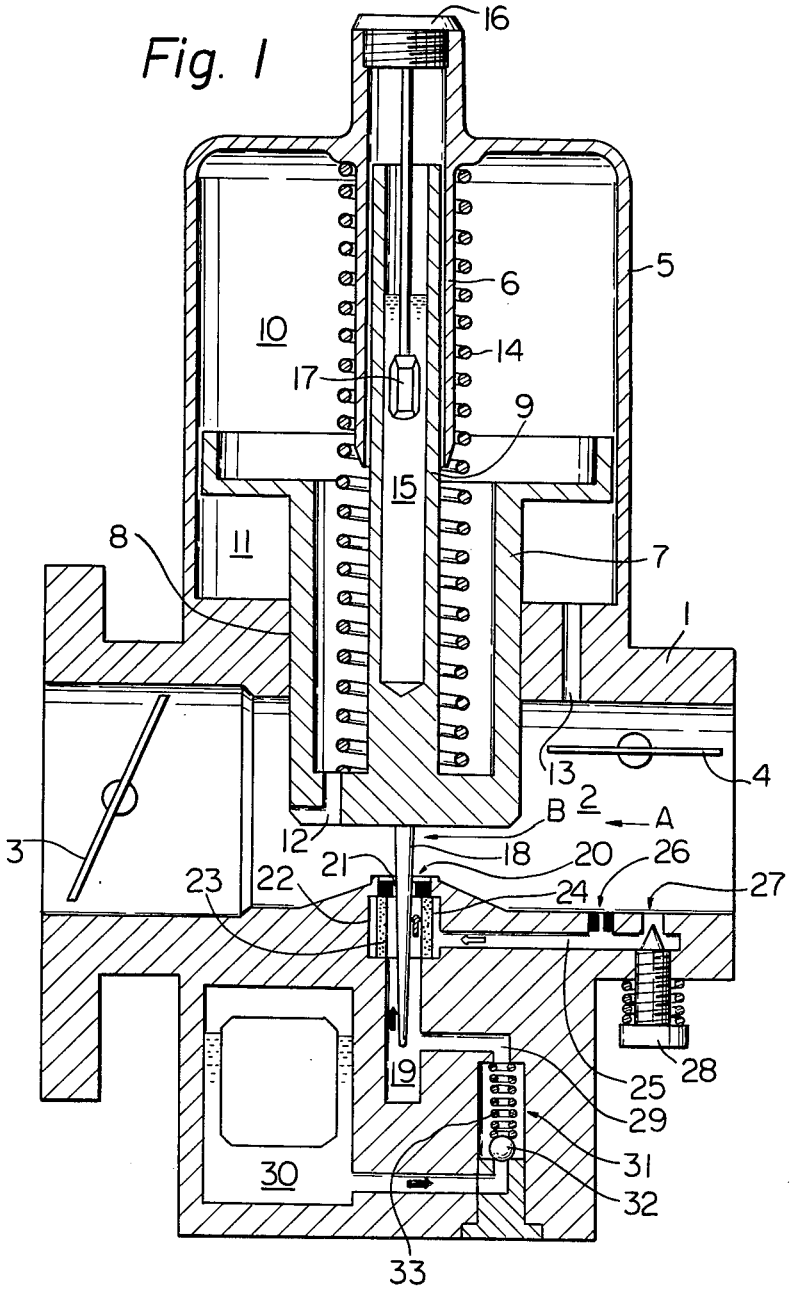
FIG. 1 is a cross-sectional side view of an embodiment of a variable venturi type carburetor according to the present invention.

Referring to FIG. 1, 1 designates a carburetor body, 2 an intake passage formed in the carburetor body 1, 3 a throttle valve and 4 a choke valve. The introduced air flows in the intake passage 2 in the direction shown by the arrow A. Reference numeral 5 designates an outer casing which has a hollow cylindrical guide 6 extending downwards in the central portion of the inside of the outer casing 5. Reference numeral 7 designates a suction piston which is slidably inserted into a guide hole 8 formed in the carburetor body 1 and is guided by the guide hole 8. In addition, the suction piston 7 has a suction piston rod 9 extending upwards. This suction piston rod 9 is slidably inserted into the hollow cylindrical guide 6 and is guided by the guide 6. A vacuum chamber 10 and an atmospheric pressure chamber 11, which are separated by the suction piston 7, are formed in the outer casing 5. The vacuum chamber 10 is connected to the intake passage 2 located downstream of the venturi portion B via a suction hole 12; thus, a vacuum is produced in the vacuum chamber 10. On the other hand, the atmospheric pressure chamber 11 is connected to the intake passage 2 located upstream of the venturi portion B via an air hole 13; thus the pressure in the atmospheric pressure chamber 11 is maintained at an approximately atmospheric pressure. A compression spring 14 is disposed between the suction piston 7 and the outer casing 5. The suction piston 7 is always biased downwards due to the spring force of the compression spring 14. The inside of the suction piston rod 9 is filled with oil 15, and a damper 17 fixed to an oil cap nut 16 is dipped in the oil 15. A needle 18 extending downwards is rigidly fixed onto the lower end of the suction piston 7 and has a cross-sectional area which gradually decreases downwards. A fuel storing chamber 19 filled with fuel is formed in the carburetor body 1. A fuel injecting jet 20 opening into the intake passage 2 is formed in the upper end of the fuel storing chamber 19. When the needle 18 moves up and down, the annular opening area 21 formed between the needle 18 and the jet 20 is accordingly changed.

The fuel storing chamber 19 has on its upper portion an annular recess 22, and a hollow cylindrical bubble generating pipe 23 made of sintered metal is disposed in the annular recess 22. The inner diameter of the bubble generating pipe 23 is equal to that of the fuel storing chamber 19. On the other hand, an annular air chamber 24 is formed between the outer wall of the bubble generating pipe 23 and the inner wall of the annular recess 22 and is connected to air bleed jets 26 and 27 via an air bleed passage 25. The opening area of the air bleed jet 27 is regulated by an idle adjuster screw 28 which serves to control an amount of bleed air at the time of idling of the engine. The fuel storing chamber 19 is connected to a float chamber 30 via a fuel passage 29, and a pressure reducing device 31 is disposed in the fuel passage 29. This pressure reducing device 31 is constructed as a check valve comprising a steel ball 32 and a compression spring 33, and only allows the outflow of fuel from the float chamber 30 to the fuel storing chamber 19.

As is known to the general public, the suction piston 7 moves up and down due to the difference between the pressure in the atmospheric pressure chamber 11 and the vacuum in the vacuum chamber 10, and the cross-sectional area of the venturi portion B is varied so that the velocity of air flowing in the venturi portion B is maintained at an approximately constant value. The fuel in the fuel storing chamber 19 is injected into the intake passage 2 via the jet 20 due to a vacuum produced in the venturi portion B.

According to the present invention, the metering operation of the bleed air is carried out due to the air bleed jets 26 and 27, and then the bleed air thus metered is injected into the fuel storing chamber 19 in the form of fine bubbles due to the presence of the bubble generating pipe 23. Thus, the fine bubbles of air are mixed with the fuel in the fuel storing chamber 19. Consequently, in order to inject into the intake passage 2 the same amount of fuel as that in a conventional carburetor, it is necessary to increase the annular opening area formed between the needle 18 and the jet 20 compared with the conventional case wherein the metering operation of the fuel containing no bubbles therein is effected. That is to say, according to the present invention, it is possible to increase the annular opening area formed between the needle 18 and the jet 20.

As mentioned above, since the velocity of air flowing in the venturi portion B is always maintained at a constant value independent of an amount of air flowing in the venturi portion B, a vacuum of a constant level, for example −100 mmAq is always produced in the venturi portion B. Consequently, if the fuel storing chamber 19 is directly connected to the float chamber 30 as is in a conventional carburetor, since the pressure in the float chamber 30 is equal to the atmospheric pressure, the pressure in the fuel storing chamber 19 is equal to an appoximately atmospheric pressure. Thus, in this case, fuel is injected into the intake passage 2 from the jet 20 due to the difference of the pressure of approximately +100 mmAq created between the vacuum in the venturi portion B and the vacuum in the fuel storing chamber 19. Contrary to this, in the present invention, the spring force of the compression spring 33 of the pressure reducing device 31 is set so that a vacuum of, for example, −90 mmAq is produced in the fuel storing chamber 19. Consequently, according to the present invention, the difference between a vacuum in the venturi portion B and a vacuum in the fuel storing chamber 19 is equal to an approximately 10 mmAq; thus, in order to inject into the intake passage 2 the same amount of fuel as that in a conventional carburetor, it is necessary to increase the annular opening area formed between the needle 18 and the jet 20 compared with the conventional case wherein the metering operation of the fuel containing no bubbles therein is effected. That is to say, by providing, the pressure reducing device 31, it is possible to further increase the annular opening area 21 formed between the needle 18 and the jet 20. In addition, in the present invention as mentioned above, a vacuum is produced in the fuel storing chamber 19, thereby promoting the generation of the bubbles in the bubble generating pipe 23. Furthermore, by using the bubble generating pipe 23 made of sintered metal since the fine bubbles are uniformly mixed with the fuel in the fuel storing chamber 19, the pulverization of the fuel injected into the intake passage 2 from the jet 20 is promoted.

Figure 2:
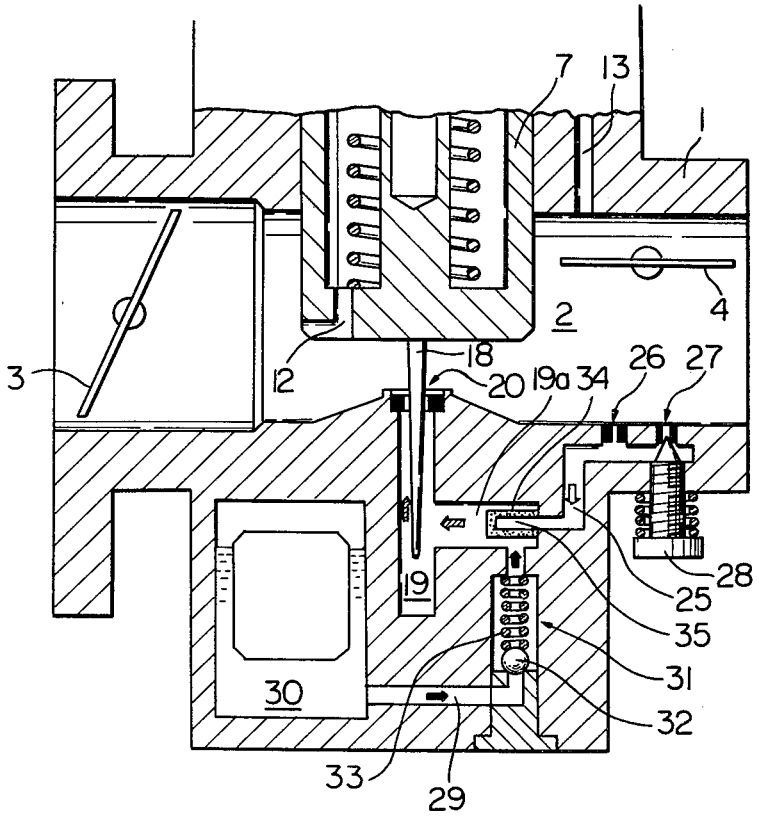
FIG. 2 is a cross-sectional side view of an alternative embodiment according to the present invention.

FIG. 2 shows an alternative embodiment of FIG. 1. In this embodiment, a fuel storing chamber portion 19*a* laterally extending from the fuel storing chamber 19 is formed in the carburetor body 1, and a cup-shaped bubble generating pipe 34 is disposed in the fuel storing chamber portion 19*a*. The inner room 35 of the bubble generating pipe 34 is connected to the air bleed jets 26 and 27 via the air bleed passage 25. In this embodiment, the distance between the bubble generating pipe 24 and the jet 20 is longer than that in the embodiment shown in FIG. 1; thus, there is an advantage in that the bubbles of air can be uniformly mixed with the fuel until the time when the fuel is injected from the jet 20.

According to the present invention, due to the fact that the bubble generating pipe made of sintered metal is disposed in the fuel storing chamber and, the fine bubbles of air are thus mixed with the fuel, it is possible to increase the annular opening area formed between the needle and the jet compared with those in a conventional carburetor. As a result of this, the irregularities in the accuracy of the size of the manufactured jet and needle and in the wear of the jet and the needle have scarcely any influence on the amount of the fuel injected from the jet. In addition, an amount of the fuel injected from the jet becomes unresponsive to a change in the temperature of the fuel. Consequently, the metering accuracy of the fuel is greatly improved. Furthermore, since it is possible to further increased the annular open area formed between the needle and the jet by providing the pressure reducing device, the metering accuracy of the fuel is further improved. In addition, by mixing the bubbles of air with the fuel, the pulverization of the fuel injected into the intake passage is promoted. As a result of this, a good distribution to each cylinder of the engine and a stable combustion can be obtained, thus reducing an amount of harmful HC and CO components in the exhaust gas. Furthermore, since the pulverization of the fuel is improved, it is not necessary to provide a slow fuel supply system as in a conventional carburetor.

While the invention has been described by referring to specific embodiments chosen for purposes of illustration, it should be apparent that numerous modifications could be made thereto by those skilled in the art without departing from the spirit and scope of the invention.

What is claimed is:

1. A variable venturi type carburetor, comprising;

a housing, a bore extending through said housing and having an inner wall defining an intake passage, a suction piston movably mounted in said housing and having a bottom end face projecting into said intake passage, said bottom end face of said suction piston and said inner wall of said intake passage defining a venturi, said suction piston moving up and down in response to a change in the vacuum produced in said intake passage located downstream of said venturi for maintaining the velocity of air flowing into said venturi at a constant value, a jet disposed on the inner wall of said intake passage at a position facing against said bottom end face of said suction piston, a needle fixed onto said bottom end face of said suction piston and entering into said jet, said jet and said needle defining an annular opening through which fuel is injected into said intake passage, a fuel reservoir in said housing;

a fuel supply passage disposed in said housing and communicating said fuel reservoir with said jet, a pressure reducing device being disposed in said fuel supply passage for decreasing the pressure of the fuel contained in said fuel passage located between said jet and said pressure reducing device, said pressure reducing device comprising a check valve which only allows the outflow of fuel from said reservoir to said jet, an air bleed passage communicating said fuel supply passage with the atmosphere, and a bubble generating pipe made of sintered metal and disposed in said fuel passage at a position in which said air bleed passage opens into said fuel supply passage for creating fine bubbles of air in the fuel contained in said fuel supply passage.

* * * * *